United States Patent [19]

Arneson et al.

[11] Patent Number: 5,018,624

[45] Date of Patent: May 28, 1991

[54] TRAYLIKE MEMBER AND COVER THEREFOR

[75] Inventors: Theodore R. Arneson, Mount Prospect; Robert F. Hitchcock, Glendale Heights; Julie D. N. Williams, Round Lake Beach, all of Ill.

[73] Assignee: Packaging Corporation of America, Evanston, Ill.

[21] Appl. No.: 513,752

[22] Filed: Apr. 24, 1990

[51] Int. Cl.[5] ..... B65D 1/34

[52] U.S. Cl. ..... 206/560; 206/477; 206/478; 206/557; 206/565; 229/2.5 R

[58] Field of Search ..... 206/477, 478, 480, 482, 206/483, 557, 560, 562, 563, 565; 229/2.5 R

[56] References Cited

U.S. PATENT DOCUMENTS

| | | | |
|---|---|---|---|
| 3,318,283 | 5/1967 | Maclam et al. | 206/557 |
| 3,420,431 | 1/1969 | Donovan | 206/557 |
| 3,464,832 | 9/1969 | Mullinix | 206/557 |
| 3,732,976 | 5/1973 | Bessett et al. | 229/2.5 |
| 4,111,305 | 9/1978 | Thomas | 206/563 |
| 4,361,233 | 11/1982 | Holkestad | 206/560 |
| 4,533,585 | 8/1985 | Holden | 229/2.5 R |
| 4,883,195 | 11/1989 | Ott et al. | 229/2.5 R |

FOREIGN PATENT DOCUMENTS

| | | | |
|---|---|---|---|
| 436471 | 1/1948 | Italy | 206/557 |

*Primary Examiner*—David T. Fidei

*Attorney, Agent, or Firm*—Neuman, Williams, Anderson & Olson

[57] ABSTRACT

A traylike member is provided for use with a removable cover to form a container in which is accommodated a product. The traylike member includes a surface which subtends and supportingly engages the product. A marginal section extends from the periphery of the surface and is spaced outwardly from the product when the latter is engaging the surface. The surface is provided with a plurality of relatively spaced locating elements which are independently adjustable between operative and inoperative modes. When in an operative mode, the locating elements project upwardly from the surface and coact with one another to restrain relative lateral movement of the supported product with respect to the surface. When in the inoperative mode, the locating elements assume non-upwardly projecting positions relative to the surface.

20 Claims, 2 Drawing Sheets

Fig. 1
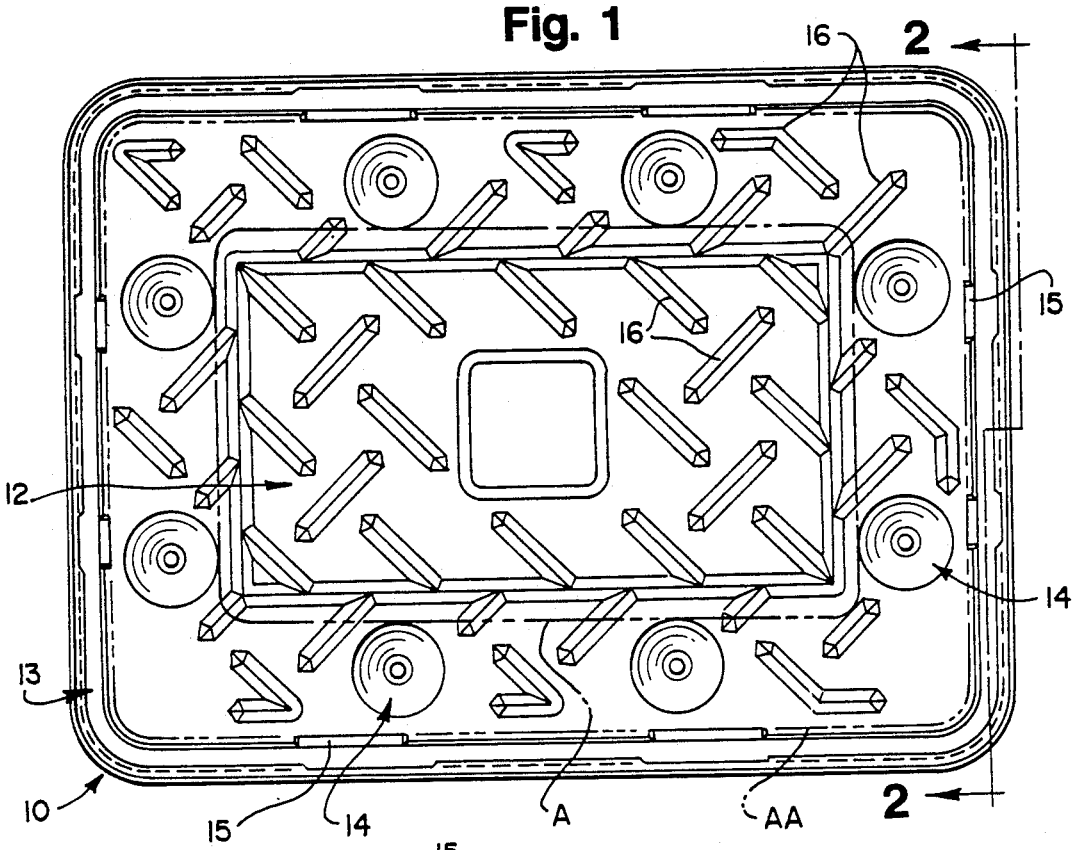
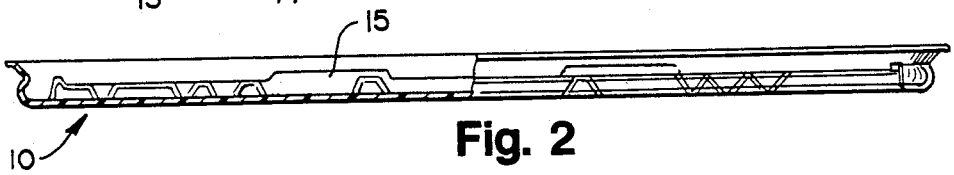
Fig. 2
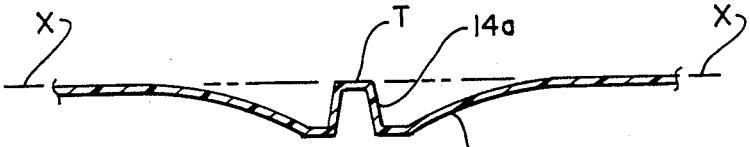
Fig. 3
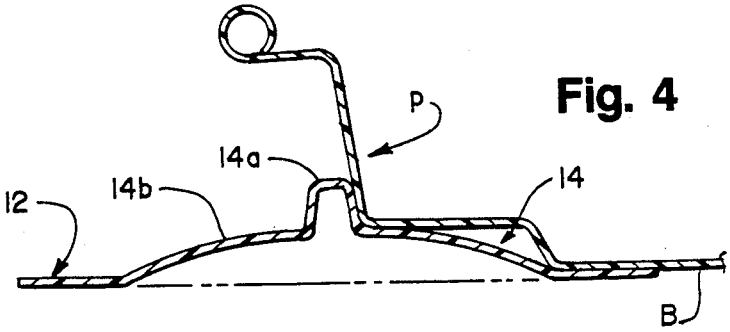
Fig. 4

TRAYLIKE MEMBER AND COVER THEREFOR

BACKGROUND OF THE INVENTION

When handling certain products such as food and/or fragile articles, it is often desirable, after the product has been placed on a supporting surface, that the product be restrained from relative lateral movement along the surface. Where, for example, the food product is a frosted cake, it is important from an esthetic standpoint that the frosted exterior surface of the accommodated cake not be in contact with upright walls, a packing ring or spacer collar. Heretofore, various rings and collars have been utilized, when packing an individual cake for transporting between locations, however, such rings and collars are beset with one or more of the following shortcomings: a) they are of costly and complex designs; b) they are awkward to handle and difficult to position about the exterior of the cake without defacing the latter; c) they provide ineffective protection for the accommodated product; d) they are incapable of accommodating products having sizes and shapes varying over a wide range; e) they are difficult to remove from the cake without deleteriously affecting the esthetic appearance of the accommodated product; and f) they add bulk and weight to the package for the product.

SUMMARY OF THE INVENTION

Thus, a traylike member has been provided which is not beset with any of the aforenoted shortcomings.

The improved traylike member is of unitary construction and may be readily thermoformed from a sheet of thin gauge inexpensive, lightweight plastic material.

The improved traylike member doesn't detract from the esthetic appeal of the accommodated product when being positioned on or removed from the member.

The improved traylike member may be readily assembled with a variety of covers.

Further and additional advantages of the improved traylike member and cover therefor will become apparent from the description, accompanying drawings and appended claims.

In accordance with one embodiment of the invention, a traylike member is provided for use with a cover. The traylike member includes a surface for subtending and supportingly engaging a product. Integral with the periphery of the surface is a marginal section which extends outwardly from the exterior side of the accommodated product. A plurality of relatively spaced locating means are provided in the surface of the traylike member and are adjustable between operative and inoperative modes. When in the operative mode, the locating means project upwardly from the surface and coact with one another to substantially restrain relative lateral movement of the product with respect to the surface. When the locating means are in the inoperative mode, they assume non-upwardly projecting positions.

BRIEF DESCRIPTION OF THE DRAWINGS

For a more complete understanding of the invention reference is made to the drawings wherein:

FIG. 1 is a top plan view of one embodiment of the improved trylike member.

FIG. 2 is a right end view of FIG. 1 shown in partial section, said section being taken along line 2—2 of FIG. 1.

FIG. 3 is a fragmentary sectional view taken along line 3—3 of FIG. 1 and showing one locating element in an inoperative mode.

FIG. 4 is similar to FIG. 3 but showing the locating element in an operative mode and engaging a secondary container, the latter forming a component of the accommodated product.

DESCRIPTION OF THE PREFERRED EMBODIMENTS

Figure 5:
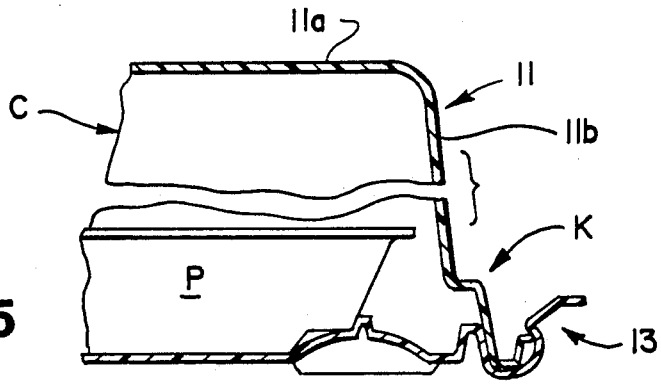
FIG. 5 is a fragmentary side elevational view on a reduced scale of the traylike member of FIG. 1 assembled with a domed cover and showing the accommodated product engaging one of a first set of locating elements adjusted to an operative mode.
Figure 6:
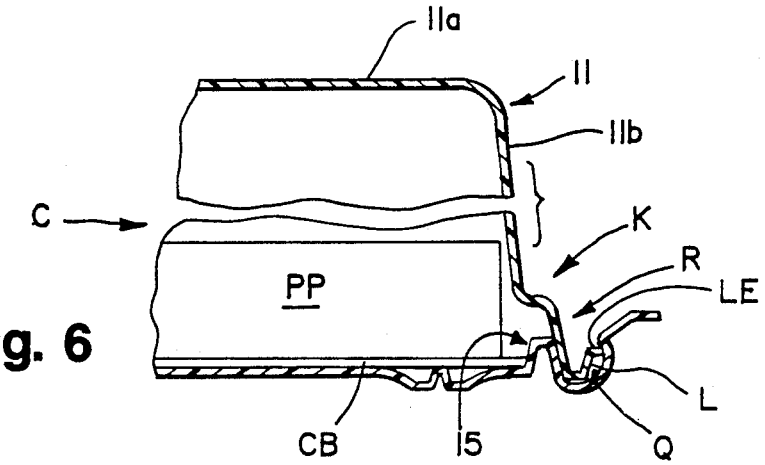
FIG. 6 is similar to FIG. 5 but showing a larger accommodated product engaging one of a second set of locating elements while the first set of locating elements are adjusted to an inoperative mode.

Referring now to the drawings and more particularly to FIGS. 1 and 2, one embodiment of the improved traylike member 10 is shown which is adapted to be used in combination with a removable cover 11 to form a container C, see FIGS. 5 and 6. The container C is adapted to accommodate a variety of products P or PP wherein it is desirable to restrain relative lateral movement of the product with respect to the traylike member 10 when the loaded container is being transported between locations (i.e., retail store and home; bakery and retail outlet).

It is preferred that the member 10 be thermoformed from a sheet of thin gauge, inexpensive plastic material, i.e. clear oriented polystyrene. The member 10 includes a central surface 12 which is adapted to subtend and supportingly engage the accommodated product P or PP. Integral with and extending outwardly from the periphery of a surface 12 is a marginal section 13.

Formed in surface 12 are a plurality, or first set, of relatively spaced locating elements 14. Each element is independently adjustable between operative (see FIG. 4) and inoperative (see FIG. 3) modes. Each element is preferably of like configuration and includes a center protuberance 14*a* and an annular portion 14*b* connecting the center protuberance to the segment of the surface 12 circumjacent the annular portion 14*b*. When the element is in the operative mode, see FIG. 4, the annular portion 14*b* assumes a dome-like configuration with the center protuberance 14*a* projecting upwardly above the plane of surface 12. When the element 14 is in the inoperative mode, the annular portion 14*b* is distorted or collapsed downwardly causing the center protuberance 14*a* to assume a non-upwardly projecting position relative to the surface 12. As seen in FIG. 3, the top T of the center protuberance 14*a* is substantially coplanar with the plane X—X of surface 12. The configuration of annular portion 14*b* is such that the element 14 will resiliently remain in either the operative or inoperative mode.

When in the operative mode, elements 14 cooperate with one another to define a first area A on surface 12, shown in phantom lines in FIG. 1. The area A is sized to accommodate a product P (i.e., a secondary container) having a bottom surface B with a configuration approximating that of area A.

A second set of locating elements 15 is provided in the surface 12 of the traylike member 10 and are fixedly arranged in relative spaced relation about the periphery of the surface. The elements 15 are nonadjustable and project upwardly a fixed amount with respect to surface 12, see FIGS. 5 and 6. The elements 15 cooperate to define a second area AA, shown in phantom lines in FIG. 1, on the surface 12. Area AA includes area A and is substantially larger in size. The size and configuration of area AA are such that a conventional, disposable underlying cakeboard CB will readily fit within area AA and the locating elements 15 will engage the periphery of the cakeboard and prevent lateral shifting thereof. To enable the locating element 15 to engage the cakeboard periphery, it is necessary that the first set of locating elements 14 assume an inoperative mode as seen in FIG. 3.

In order to provide added reinforcement and stiffness to surface 12, the latter may be provided with a plurality of reinforcing, offset segments 16 which may be arranged in various patterns. The segments may have various shapes and sizes; however, in the illustrated embodiment, the segments are trough-like recesses. As seen in FIG. 1 the segments 16 are spaced from both sets of locating elements 14 and 15.

Figure 7:
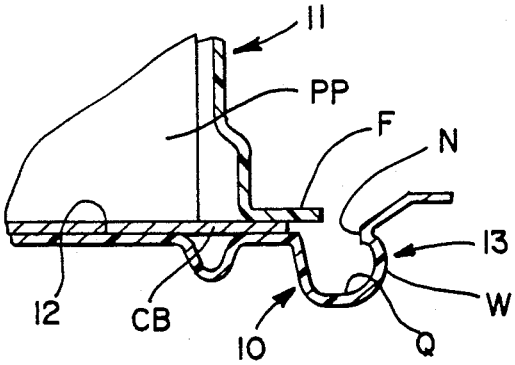
FIG. 7 is an enlarged fragmentary vertical section of a corner of the traylike member and cover assembled thereon and showing a portion of a cakeboard of the accommodate product interposed the member and cover.
Figure 8:
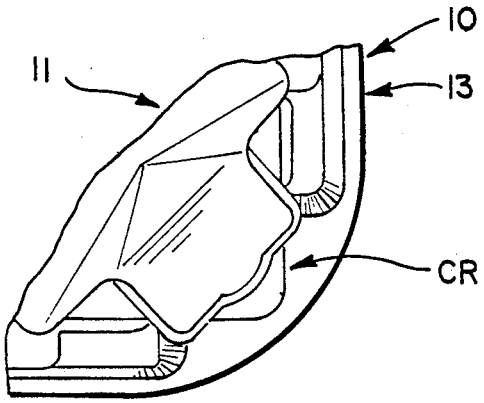
FIG. 8 is a fragmentary bottom view of a corner of the cover per se, the latter being shown in FIGS. 5 and 6.

As aforementioned, the traylike member 10 is normally used in combination with a dome-type cover 11, see FIGS. 5, 6 and 7. The cover includes a central portion having a top section 11*a* and a depending side section 11*b* which is integral with the periphery of the top section. The cover central portion may have a variety of geometric shapes (i.e. circular, rectangular, square, oblong, triangular) and will depend upon the configuration of the traylike member on which the cover is assembled and the configuration of the accommodated product. The lower portion of the side section maybe provided with outwardly offset shoulders K, see FIGS. 5, 6 and 7. Depending from the outer periphery of the shoulder K, except at the corners CR of the cover C, is rim portion R defining an outwardly and upwardly facing loop L.

Where The cover central portion has a configuration wherein the side section is provided with external upwardly extending corners, certain of said corners CR of the cover C are provided with flanges F which project outwardly from the lower portions of the shoulders K, see FIG. 7. Each flange F is adapted to overlie a corner portion CR of a cakeboard or supporting plate CB on which a cake PP is normally placed when it is to be frosted. Thus, the cakeboard peripheral portions are sandwiched between the corner flanges and corresponding portions of the traylike member marginal section.

When the cover 11 is assembled on the traylike member 10, the shoulders K of the cover engage upwardly extending surfaces of locating elements 15 and the loop L of the rim portion R is accommodated in an upwardly facing pocket Q formed in the marginal section 13 of the traylike member. An outwardly disposed wall segment W of the pocket is provided with a plurality of laterally spaced nubs N which are adapted to overlie and lockingly engage an outer lip edge LE of loop L when the cover is assembled on the traylike member. The pocket wall W is resiliently distortable outwardly to allow the loop outer lip edge to pass the nubs N when the cover is being assembled on, or disassembled from the traylike member.

Besides providing a locking component for effecting interlocking of the cover and traylike member, the pocket Q serves to reinforce the periphery of the traylike member per se.

When the accommodated product PP is a frosted cake or similar fragile item, it is important that the cover top section 11*a* and side section 11*b* be spaced from the product exterior. Preferably the cover 11 should be of a transparent material thereby allowing the accommodated product to be readily observed without requiring removal of the cover.

In the embodiment illustrated in FIG. 5, the accommodated product P, as aforementioned, may be a secondary container formed of aluminum foil or the like. While the lower portion of the container side wall is shown as having a concave configuration which conforms substantially to the convex curvature of the annular portions 14*b* of the locating elements 14, such a concave configuration is not essential. It is important, however, that the bottom B of the product P be disposed within area A and the periphery of the bottom B be in substantial abutting engagement with the lower perimeter of the annular portion 14*b* of the locating element 14 when the latter is in the operative mode, see FIG. 5.

Thus, a traylike member has been provided which is of simple, inexpensive, yet sturdy construction and incorporates integral locating means which are adjustable between operative and inoperative modes. When in the operative mode the locating means substantially restrain lateral relative movement of a product when accommodated by the traylike member. The traylike member may be readily used in combination with a cover to form an attractive container which provides effective protection for the accommodated product when the loaded container is subjected to normal handling.

We claim:

1. A traylike member comprising a surface for subtending and supporting a product; a marginal section extending from the periphery of said surface and adapted to be spaced outwardly from the product when supported by said surface; and a plurality of relatively spaced locating means provided on said surface and being adjustable relative thereto between operative and inoperative modes; when in said operative mode, said locating means projecting upwardly from said surface and coacting with one another to substantially restrain relative lateral movement of the supported product with respect to said surface, and when in an inoperative mode, said locating means assuming substantially nonupwardly projecting positions relative to said surface.

2. The traylike member of claim 1 wherein the marginal section is substantially continuous and at least a portion thereof forms an upwardly facing pocket encompassing the periphery of the product-supporting surface.

3. The traylike member of claim 1 wherein the plurality of locating means cooperate to at least partially define an area of said surface which is adapted to be engaged by the product.

4. The traylike member of claim 1 wherein said member is of unitary construction and is thermoformed from a sheet of plastic material.

5. The traylike member of claim 3 wherein the plurality of locating means are arranged between the marginal section and the product when the latter is supportingly engaged by said surface area.

6. The traylike member of claim 3 wherein the defined surface area is provided with reinforcing means.

7. The traylike member of claim 6 wherein the reinforcing means includes a plurality of trough-like recesses spaced from said locating means.

8. The traylike member of claim 1 including second locating means spaced laterally outwardly from the first mentioned locating means and disposed proximate said marginal section, said second locating means being operative only when the first mentioned locating means are in the inoperative mode.

9. A traylike member in combination with a removable cover and forming a container in which a product is accommodated; said traylike member comprising a surface for subtending and supportingly engaging the product; a marginal section encompassing said surface; and a plurality of relatively spaced locating means provided on said surface and independently adjustable between operative and inoperative modes; only when in an operative mode, said locating means projecting upwardly from said surface and coacting with one another for substantially restraining relative lateral movement of the accommodated product with respect to the surface; said cover including a central portion overlying in spaced relation said surface and the product supported thereby, and a rim portion encompassing said central portion and being removably assembled with the marginal section of the traylike member.

10. The combination of claim 9 wherein the marginal section of the traylike member includes an upwardly facing pocket proximate to and in substantially concentric relation with the surface periphery.

11. The combination of claim 10 wherein the pocket of the marginal section releasably interlocks with the cover rim portion, when said cover and traylike member are in assembled relation.

12. The combination of claim 9 wherein the cover has a dome-like configuration.

13. The combination of claim 10 wherein a pocket-forming wall of said traylike member includes inwardly protruding means for releasably interlocking with the cover rim portion when said traylike member and said cover are in assembled relation, said pocket-forming wall being resilient and outwardly distortable when said cover is being assembled with or disassembled from said traylike member.

14. The combination of claim 9 wherein the traylike member and the cover are each thermoformed from a sheet of thin gauge plastic material.

15. The combination of claim 9 wherein the traylike member is provided with relatively spaced second locating means spaced laterally outwardly from the first mentioned locating means and disposed proximate the marginal section; said second locating means being operative only when said first mentioned locating means are in the inoperative mode.

16. The combination of claim 13 wherein the cover rim portion is provided with an outer lip edge, the latter being disposed beneath and in resilient interlocking engagement with the protruding means of said pocket-forming wall when the cover and traylike member are in assembled relation.

17. The combination of claim 15 wherein the first mentioned locating means, when in an operative mode, cooperate with one another to at least partially define a first area of said surface and the second locating means cooperate with one another to at least partially define a second area of said surface, said second area being of greater size than and including the first area.

18. The combination of claim 17 wherein all of the first mentioned locating means of the traylike member are disposed within the second area.

19. The combination of claim 15 wherein the second locating means are stationary relative to the surface.

20. The combination of claim 19 wherein the central portion of the cover includes a top section and a side section depending from the periphery of said top section, said side section having a lower portion provided with outwardly offset shoulder, predetermined first segments of said shoulder defining an inner wall of a rim portion, said rim portion including an outer wall spaced outwardly from said inner wall and defining an upwardly facing loop, the latter substantially encircling the cover central portion; predetermined second segments of said shoulder defining laterally extending outwardly projecting flanges, said flanges cooperating with corresponding portions of the traylike member marginal section for sandwiching therebetween corner segments of the accommodated product when the cover and traylike member are in assembled relation.

* * * * *